US009846989B2

(12) United States Patent
Saraf et al.

(10) Patent No.: US 9,846,989 B2
(45) Date of Patent: Dec. 19, 2017

(54) IDENTIFYING IDLE GAMING MACHINES

(71) Applicant: WMS Gaming, Inc., Waukegan, IL (US)

(72) Inventors: Mahendra A. Saraf, Pune (IN); Srinivyasa M. Adiraju, Vernon Hills, IL (US); Vishvesh S. Paranjape, Pune (IN)

(73) Assignee: BALLY GAMING, INC., Las Vegas, NV (US)

( * ) Notice: Subject to any disclaimer, the term of this patent is extended or adjusted under 35 U.S.C. 154(b) by 416 days.

(21) Appl. No.: 14/517,070

(22) Filed: Oct. 17, 2014

(65) Prior Publication Data

US 2015/0111636 A1 Apr. 23, 2015

Related U.S. Application Data

(60) Provisional application No. 61/892,230, filed on Oct. 17, 2013.

(51) Int. Cl.
*G07F 17/32* (2006.01)

(52) U.S. Cl.
CPC ..... *G07F 17/3234* (2013.01); *G07F 17/323* (2013.01); *G07F 17/3227* (2013.01); *G07F 17/3237* (2013.01); *G07F 17/3255* (2013.01); *G07F 17/3269* (2013.01)

(58) Field of Classification Search
CPC ..... G07F 17/3255; G07F 17/3269
See application file for complete search history.

(56) References Cited

U.S. PATENT DOCUMENTS

| | | | | |
|---|---|---|---|---|
| 6,361,437 | B1 | 3/2002 | Walker et al. | |
| 7,828,652 | B2 | 11/2010 | Nguyen et al. | |
| 8,070,576 | B2 | 12/2011 | Bennett et al. | |
| 8,308,574 | B2 | 11/2012 | Burke et al. | |
| 8,357,035 | B2 | 1/2013 | Burke et al. | |
| 8,376,837 | B2 | 2/2013 | Gagner et al. | |
| 8,430,745 | B2 | 4/2013 | Agarwal et al. | |
| 8,460,107 | B2 | 6/2013 | Barclay et al. | |
| 8,672,752 | B2 | 3/2014 | Gagner et al. | |
| 8,764,566 | B2 | 7/2014 | Miltenberger et al. | |
| 2005/0113172 | A1* | 5/2005 | Gong | G07F 17/32 463/42 |
| 2006/0148560 | A1* | 7/2006 | Arezina | G07F 17/32 463/29 |
| 2007/0032295 | A1 | 2/2007 | Muir et al. | |
| 2007/0136817 | A1 | 6/2007 | Nguyen | |

(Continued)

FOREIGN PATENT DOCUMENTS

| | | |
|---|---|---|
| CA | 2151990 | 12/1995 |
| WO | 03083796 | 10/2003 |

*Primary Examiner* — Steven J Hylinski
(74) *Attorney, Agent, or Firm* — DeLizio Law, PLLC

(57) ABSTRACT

A method for monitoring wagering machines and transmitting indications of idle wagering game machines is described herein. The method can include monitoring, at a wagering game server, credit meters of a plurality of wagering game machines. The method can further include determining, at the wagering game server based on the monitored credit meters, that a wagering game machine of the plurality of wagering game machines is idle. The method can further include transmitting, to a mobile device via a communications network, an indication that the wagering game machine is idle, the indication including an incentive available in exchange for gameplay on the wagering game machine.

22 Claims, 9 Drawing Sheets

(56) References Cited

U.S. PATENT DOCUMENTS

2007/0197275 A1 8/2007 Gagner
2008/0139306 A1 6/2008 Lutnick et al.
2009/0197684 A1* 8/2009 Arezina ..... G07F 17/3216 463/42
2009/0239657 A1* 9/2009 Ryan ..... G07F 17/32 463/25
2009/0239660 A1* 9/2009 Acres ..... G07F 17/32 463/25
2010/0298040 A1 11/2010 Joshi et al.
2011/0045908 A1 2/2011 Ehrlich et al.
2012/0040751 A1 2/2012 Peters
2012/0315981 A1 12/2012 Gagner et al.
2013/0012301 A1* 1/2013 Dorr ..... G07F 17/3255 463/25
2013/0053148 A1* 2/2013 Nelson ..... G07F 17/323 463/42
2013/0090158 A1* 4/2013 Hornik ..... G07F 17/3255 463/25
2013/0273996 A1* 10/2013 Froy, Jr. ..... G07F 17/34 463/20
2013/0281194 A1* 10/2013 Johnson ..... G07F 17/3244 463/25
2013/0288778 A1* 10/2013 Johnson ..... G07F 17/3204 463/25
2013/0337895 A1* 12/2013 Froy ..... G07F 17/3218 463/25
2015/0111636 A1* 4/2015 Saraf ..... G07F 17/3234 463/25
2015/0228157 A1* 8/2015 Brunell ..... G07F 17/3255 463/25

* cited by examiner

IDENTIFYING IDLE GAMING MACHINES

RELATED APPLICATIONS

This application claims the priority benefit of U.S. Provisional Application Ser. No. 61/892,230 filed Oct. 17, 2013.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

FIELD

Embodiments of the inventive subject matter relate generally to wagering game systems, and more particularly to wagering game systems including idle wagering game machine notifications.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Introduction

This section provides an introduction to some embodiments of the invention.

In an effort to increase profits, wagering game machine operators seek to decrease the amount of time wagering game machines are idle. Embodiments of the inventive subject matter monitor wagering game machines to determine if the wagering game machines are idle. When it is determined that a wagering game machine is idle, embodiments of the inventive subject matter send notifications to prospective players indicating that the wagering game machine is idle and incentivizing the players to play the idle machine. Such a system can increase wagering game machine coin-in and thus profits.

Figure 1:
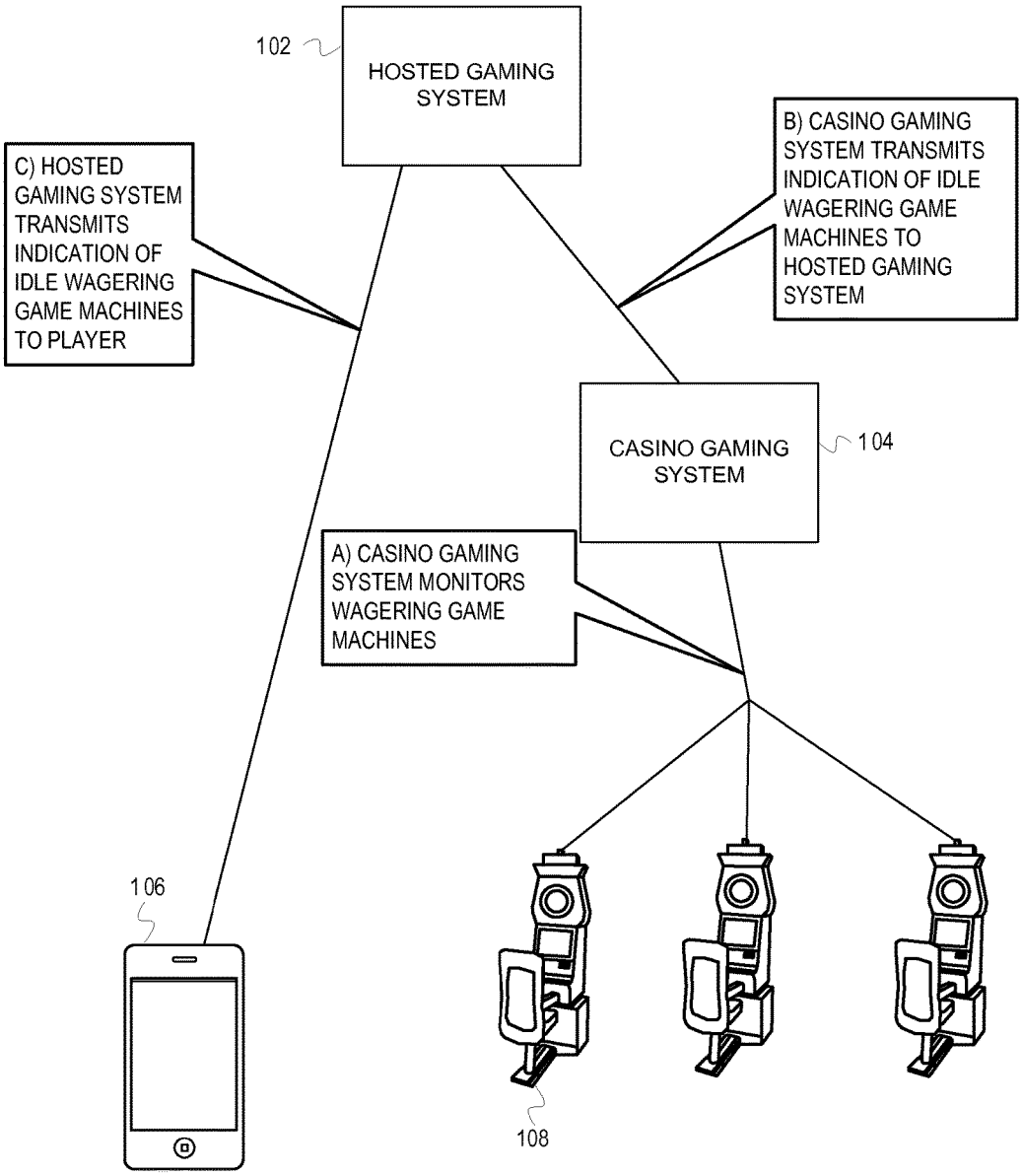
FIG. 1 is a conceptual diagram depicting an example system for monitoring wagering game machines and transmitting indications of idle wagering game machines.

Although FIG. 1 describes some embodiments, the following sections describe many other features and embodiments.

FIG. 1 is a conceptual diagram depicting an example system for monitoring wagering game machines and transmitting indications of idle wagering game machines. The example system comprises wagering game machines 108, a casino gaming system 104, a hosted gaming system 102, and a mobile device 106. FIG. 1 depicts operations at stages A-C. The stages are examples and are not necessarily discrete occurrences over time (e.g., operations of different stages may overlap).

At stage A, the casino gaming system 104 monitors the wagering game machines 108 to determine whether any of the wagering game machines 108 are idle. For example. The casino gaming system 104 can monitor credit meters associated with the wagering game machines 108, cash-out activity at the wagering game machines 108, whether a player tracking card has been or is currently being used at the wagering game machines 108, etc. For ease of discussion, the examples will proceed assuming that the casino gaming system 104 is monitoring credit meters associated with the wagering game machines 108 to determine if any of the wagering game machines 108 are idle. Additionally, this discussion will use the terms idle and available interchangeably to refer to wagering game machines that are not currently being used.

At stage B, the casino gaming system 104 transmits indications of the idle wagering game machines 108 to the hosted gaming system 102. In some embodiments, multiple casino gaming systems 104 transmit the indications to the hosted gaming system 102. For example, each casino gaming system 104 can be associated with a different casino, different types of wagering game machines 108 in a casino, a group of casinos, etc. The hosted gaming system 102 aggregates information received from the casino gaming system 104.

At stage C, the hosted gaming system 102 transmits indications of the idle wagering game machines 108 to a player. For example, the hosted gaming system 102 can push the indications to an application running on a mobile device 106. Alternatively, the application (or a web browser) running on the mobile device 106 can request the indications from the hosted gaming system 102. In some embodiments, the player logs into a service (via the application on the mobile device or via a webpage on the mobile device). The player login information can be associated with wagering game preference information (as well as any other information relevant to the player). The hosted gaming system 102 can leverage the player login information to determine that a specific wagering game machine 108 that is idle is suited to the player's preferences. Additionally, the hosted gaming system 102 can utilize the mobile device's 106 location information to determine idle wagering game machines 108 near the player. The hosted gaming system 102 can then target specific players when wagering game machines 108 that they might be interested in playing are available. Although stage C depicts the hosted gaming system 102 transmitting indications of idle wagering game machines to a mobile device 106, in some embodiments, the hosted gaming system also transmits the indications back to the casino gaming system 104. In such embodiments, players have logged in using player login information at a wagering game machine 106 (e.g., by inserting a player tracking card). The hosted gaming system 102 determines a wagering game machine 108 that is better suited to the player's preferences and is idle. The hosted gaming system 102 transmits an indication of the player as well as indication of the wagering game machine 106 that is idle that is better suited to the player to the casino gaming system 104. The casino gaming system 104 can then transmit a notification to the wagering game machine 106 that the player is playing. The notification can alert the player that a wagering game machine that is a better match to their preferences is available.

Figure 2:
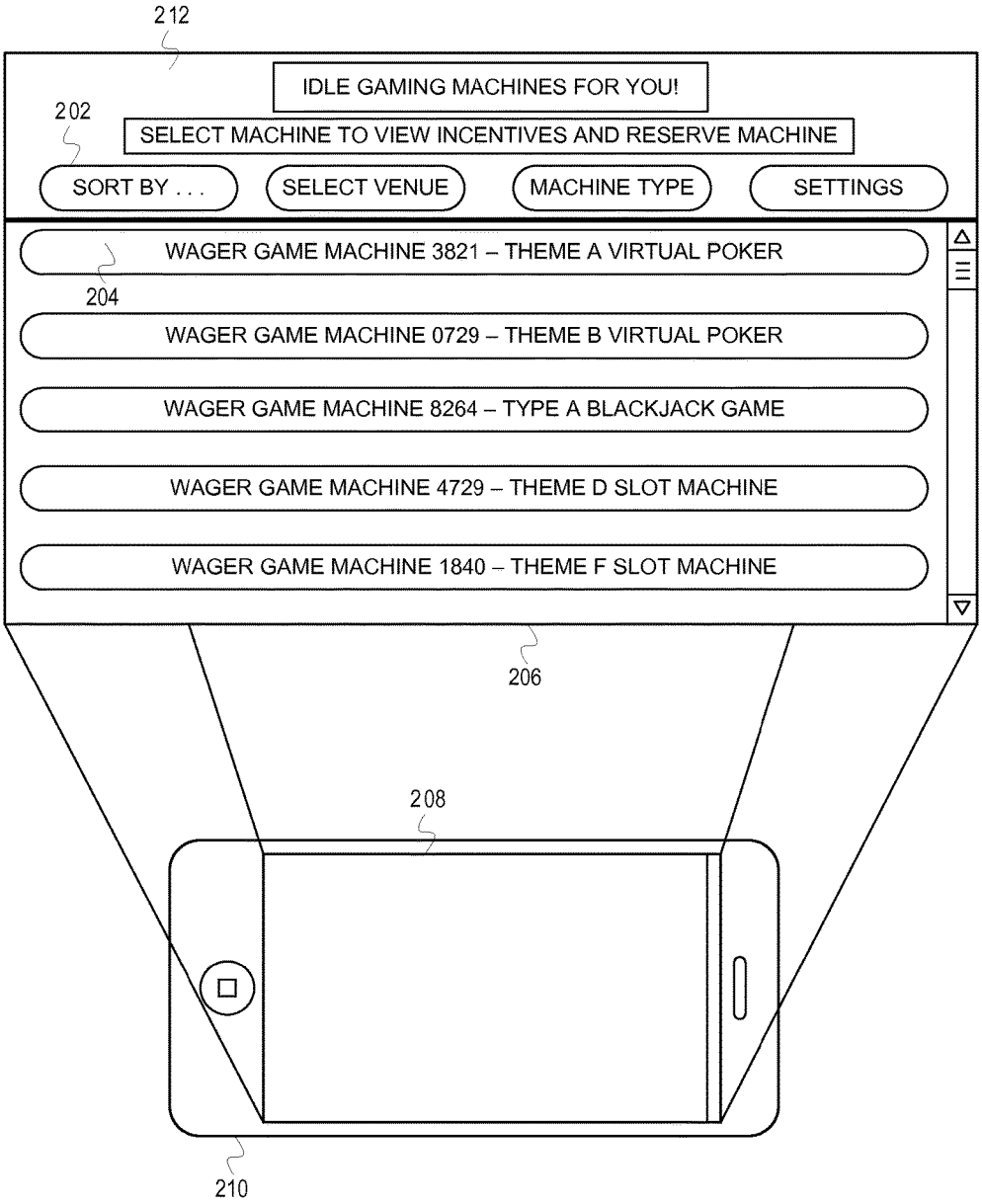
FIG. 2 depicts a mobile device 210 presenting a graphical user interface (GUI) 212 including a list of idle wagering game machines.

While FIG. 1 depicts a broad overview of an example system for monitoring wagering game machines, FIG. 2 depicts an example presentation of idle wagering game machines on a mobile device.

FIG. 2 depicts a mobile device 210 presenting a graphical user interface (GUI) 212 including a list of idle wagering game machines. FIG. 2 depicts a mobile device 210 having a display device 208, as well as an expanded view 206 of the display device 208. The expanded view 206 comprises a GUI 212. The GUI 212 includes menu options 202 and indications of idle wagering game machines 204. The menu options 202 can includes, for example, a "sort by" feature, allowing players to sort the idle wagering game machines by type, theme, wager amount, etc., a "select venue" option, allowing players to select a venue or casino from which to view idle wagering game machines, a "machine type" feature, allowing the player to select a certain machine type of idle wagering game machines to display, and a "settings" feature allowing players to select preferences and settings for idle wagering game machine presentation. Although the GUI can include a "select venue" option, in some embodiments, the hosted gaming system can utilize the mobile device's 210 location services to determine a casino at which the player is currently located. In such embodiments, the GUI can by default include indications of idle wagering game machines in the casino at which the player is currently located. Additionally, the settings feature can allow players to sign up (using player login information) for an idle wagering game machine notification service. For example, the player can register with the idle wagering game notification service and request that short message service (SMS) messages indicating idle wagering game machines be sent to him/her.

The indications of idle wagering game machines 204 include a name of the wagering game machine that is idle (i.e., "Wagering Game Machine 3821"), a type of wagering game offered on the idle wagering game machine (i.e., poker), and a theme of the idle wagering game machine (i.e., "Theme A"). The indications of idle wagering game machines 204 can include more or less information. The GUI 212 can be presented via an application running on the mobile device 210, or via a webpage accessed by the mobile device 210. In some embodiments, the player can select one of the indications of idle wagering game machines 204 to view more information about the idle wagering game machines, reserve the idle wagering game machines (as described in the discussion of FIG. 3), receive directions to the idle wagering game machine, be presented a map showing the location of the idle wagering game machine, view incentives available for reserving and subsequently playing the idle wagering game machine, etc.

Figure 3:
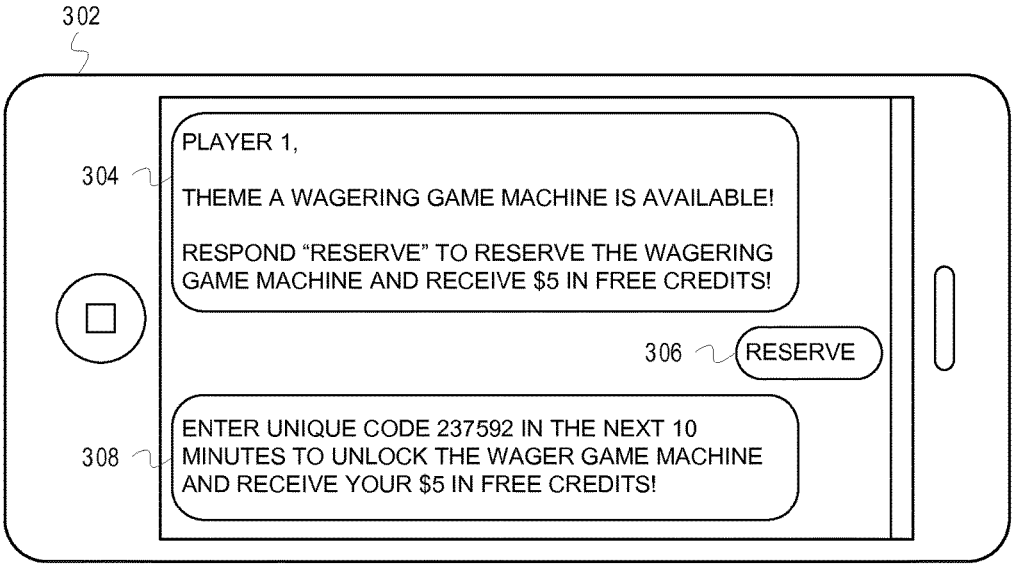
FIG. 3 depicts a mobile device 302 presenting an example dialogue for reserving an idle wagering game machine.

While FIG. 2 depicts a GUI including indications of idle wagering game machines, FIG. 3 depicts a notification sent to a player's mobile device indicating that a wagering game machine is idle.

FIG. 3 depicts a mobile device 302 presenting an example dialogue for reserving an idle wagering game machine. In some embodiments, a player subscribes to an idle wagering game notification service using player login information. The player login information can be associated with player preferences for wagering game machines. Additionally, the player can choose how they would like to be notified of idle wagering game machines (e.g., by multimedia messaging service (MMS) message, SMS message, email, etc.). As depicted in FIG. 3, the hosted gaming system has sent an SMS message notification 304 to the mobile device 302. The notification 304 indicates that a wagering game machine having wagering games of "Theme A" is available. Additionally, the notification alerts the player that he/she can reserve the idle wagering game machine and will receive five dollars in free credits for reserving the idle wagering game machine and subsequently playing the idle wagering game machine. The system can provide any suitable incentive for reserving an idle wagering game machine. As depicted by FIG. 3, the player has reserved the idle wagering game machine by responding "reserve" in a response message 306. As depicted in FIG. 3, the hosted gaming system has sent a reservation confirmation 308 to the mobile device 302. The reservation confirmation 308 includes a unique code that the player must enter at the idle wagering game machine in the next "X" minutes (e.g., ten minutes) to unlock the wagering game machine and receive the incentive (i.e., five dollars in free credits). In some embodiments, when a player reserves an idle wagering game machine, the wagering game machine cannot be used until a unique code (supplied to the reserving player) is entered. This "locked" period can persist for a period of time (i.e., if the reserving player has not entered the unique code within the time period, the idle wagering game machine becomes unlocked and anyone else can use the idle wagering game machine). In some embodiments, the time period is predetermined, dynamically determined, or determined in any suitable way. In some embodiments, the player can unlock the wagering game machine by inserting a player tracking card, logging into a player account via the wagering game machine, etc. Additionally, the incentives can include, for example:

Free play (i.e., non-cashable credits)

Credit on the idle wagering game machine (i.e., cashable credits)

Bonus games

Enhancements within a game on the idle wagering game machine (e.g., free wilds, unlocked episodes or levels, provide greater odds for the game (e.g., a modified pay table), new game elements, access to improved avatars, etc.)

Incentives independent of a game on the idle wagering game machine (e.g., coupons for food, entertainment, drinks, or any other casino hospitality item or service)

Additionally, in some embodiments, the hosted gaming system stores game state information for players. For example, for an episodic game, the hosted gaming system can save data as the player plays the episodic game and associate the data with a player ID corresponding to the player. In such embodiments, the hosted gaming system can send the player notifications when a wagering game machine having the episodic game is available. The player can then use the wagering game machine to continue play of the episodic game where the player left off. Additionally, storing the game state information allows the player to continue the episodic game on any wagering game machine in any casino having the episodic game. In some embodiments, the hosted gaming system also provides the player with directions to the wagering game machine. For example, the hosted gaming system can transmit a map with a highlighted route to the wagering game machine, send turn-by-turn directions to the wagering game machine to the player, etc.

Figure 4:
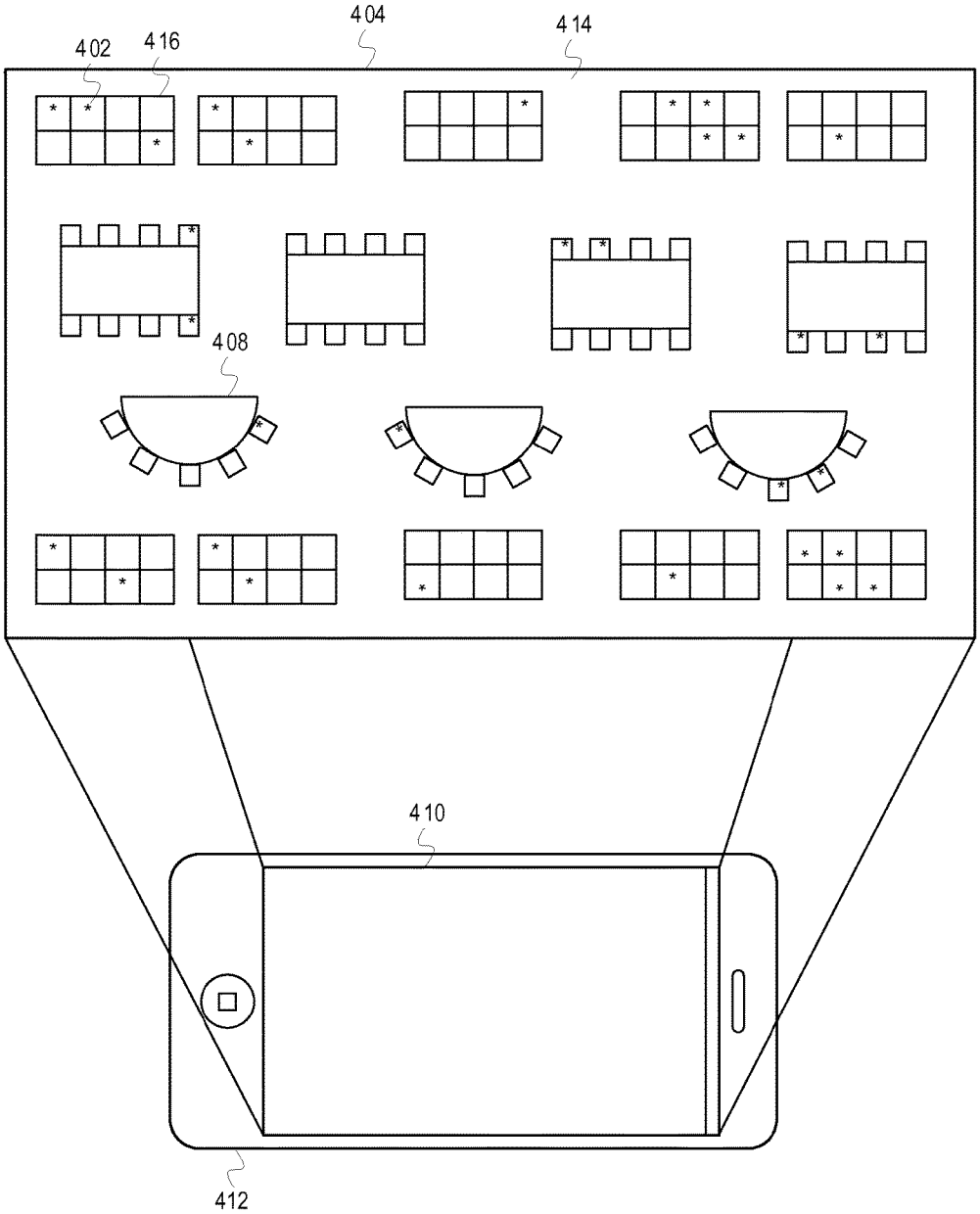
FIG. 4 depicts a mobile device 412 presenting a map 414 of a casino which indicates idle wagering game machines and idle positions at table games.

While FIG. 3 depicts a notification sent to a player's mobile device indicating that a wagering game machine is idle, FIG. 4 depicts a map of a casino including indications of idle wagering game machines.

FIG. 4 depicts a mobile device 412 presenting a map 414 of a casino which indicates idle wagering game machines and idle positions at table games. In addition to alerting players about idle wagering game machines, in some embodiments, the hosted gaming system can notify players about open seating positions at table games. FIG. 4 includes a mobile device 412 having a display device 410, and an expanded view 404 of the mobile device's 412 display device 410. The mobile device 412 is presenting a map of a casino 414. The map of the casino 414 includes banks of wagering game machines 416 and game tables 408. The available wagering game machines and positions at the table games are indicated by asterisks 402. In some embodiments, the players can select a specific wager game machine, bank of wagering game machines 416, position at a table game, or game table 408 to access information about the machine or table. For example, a player can select a specific idle wagering game machine to receive directions or a route to the idle wagering game machine. Additionally, upon selection of a specific wagering game machine, the mobile device 412 can present information about the wagering game machine such as games available, themes, minimum and maximum bets, time since last jackpot, etc. In some embodiments, selection of a specific idle wagering game machine or idle position at a table game allows the player to reserve the idle wagering game machine or idle position at the table game.

Figure 5:
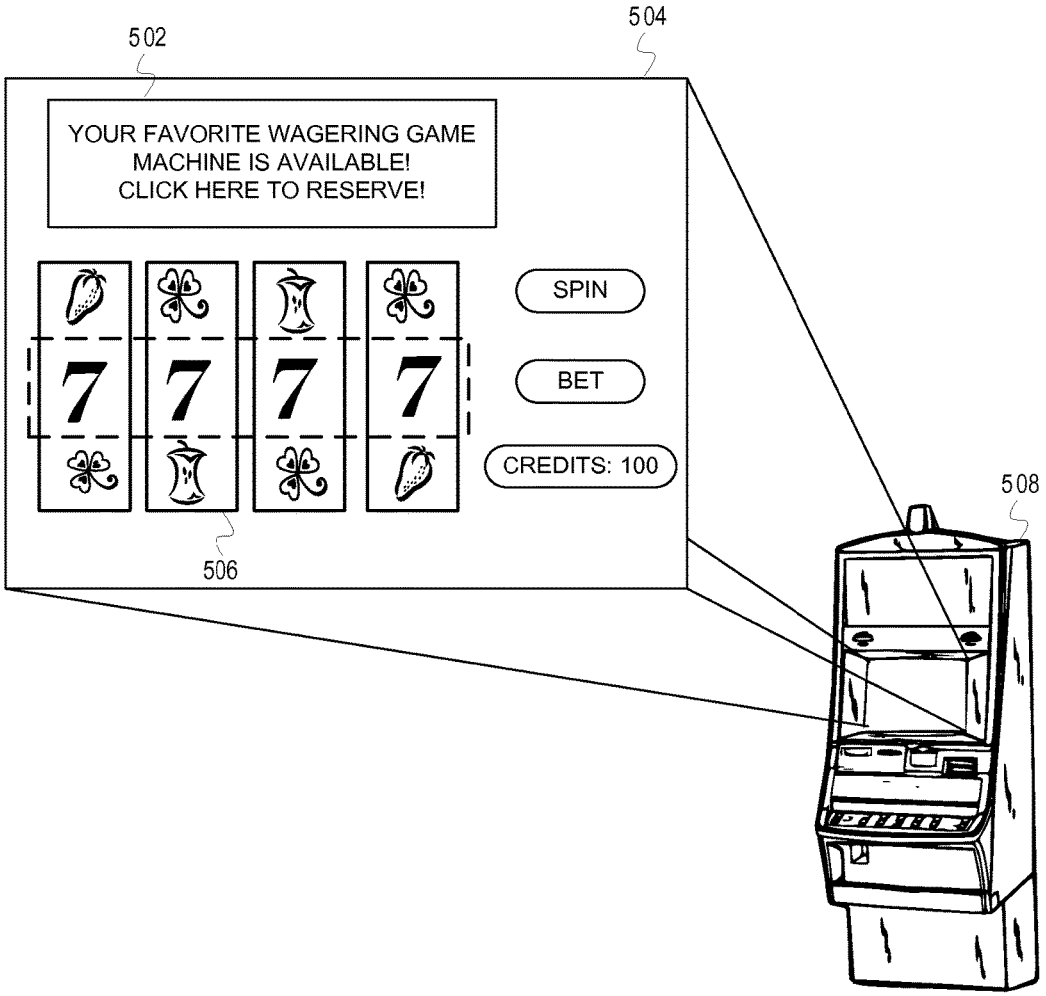
FIG. 5 depicts a wagering game machine 508 presenting a player interface window 502 indicating that a wagering game machine is available.

While FIG. 4 depicts a mobile device presenting a map of a casino, FIG. 5 depicts a wagering game machine presenting a player interface window alerting a player that a wagering game machine matching his/her preferences is available.

FIG. 5 depicts a wagering game machine 508 presenting a player interface window 502 indicating that a wagering game machine is available. FIG. 5 includes a wagering game machine 508 and an expanded view 504 of the wagering game machine's 508 display device. In some embodiments, players login or insert a player tracking card when playing a wagering game machine 508. Player information (e.g., player ID, player preferences, etc.) is transmitted by the casino gaming system to the hosted gaming system (in addition to indications of idle wagering game machines). The hosted gaming system matches the player preferences to idle wagering game machines that match the player information. For example, Player A is playing a slot game 506 having Theme 1 on the wagering game machine 508. Based on the player information, the hosted gaming system determines that Player A prefers video poker games with Theme 2. Additionally, the hosted gaming system has received an indication from the casino gaming system that a wagering game machine having video poker of Theme 2 is idle. The hosted gaming system can transmit an indication to the casino gaming system that Player A would prefer to play the idle wagering game machine having video poker of Theme 2. The casino gaming system can then send an indication to the wagering game machine 508 that a wagering game machine nearby is idle and has video poker of Theme 2. As depicted in FIG. 5, the wagering game machine 508 is presenting a player interface window 502 informing the player that their favorite wagering game machine (i.e., a wagering game machine having video poker of Theme 2) is idle. Additionally, as discussed previously, the player can reserve the idle wagering game machine. For example, the player can reserve the idle wagering game machine, and unlock the idle wagering game machine by logging in, inserting their player tracking card, entering a unique code, etc. Additionally, the wagering game machine 508 (or the casino gaming system) can determine when it is appropriate to present the player interface window 502 indicating that a wagering game machine is idle. For example, the wagering game machine 508 (or casino gaming system) may not present the player interface window 502 during active game play or particular portions of active game play (e.g., a large win, a bonus game, etc.).

Although examples refer to sending notifications to mobile devices indicating idle wagering game machines, in some embodiments, the hosted gaming system can aggregate idle wagering game information from the casino gaming system and publish the idle wagering game information on one or more large display devices throughout a casino. For example, large display devices can be located throughout a casino, each containing a list of some or all of the idle wagering game machines in the casino. As wagering game machines become idle or become in use, the hosted gaming system can update the list of idle wagering game machines. Similarly, in some embodiments, players do not subscribe to an idle wagering game notification service. Instead, the hosted gaming system publishes a list of idle wagering game machines to a website, to an application that can be accessed on a mobile device, etc. Additionally, in some embodiments, the hosted gaming system manipulates the list using various algorithms. For example, the hosted gaming system can place only low-performing idle wagering game machines on the list in an attempt to increase gameplay on the low-performing idle wagering game machines. Additionally, the hosted gaming system can provide greater incentives for low-performing wagering game machines.

In some embodiments, players can configure the type of notifications received from the hosted gaming system. For example, players can choose to be notified only about wagering game machines having certain games (e.g., video poker, video blackjack, slot games, etc.), certain themes, certain types of wagering game machines (e.g., wagering game machines with greater or less player interactivity), wagering game machines with mechanical reels, wagering game machines with high or low volatility, wagering game machines made by a specific manufacturer or group of manufacturers, wagering game machines only in a casino that they are currently in, etc.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 6:
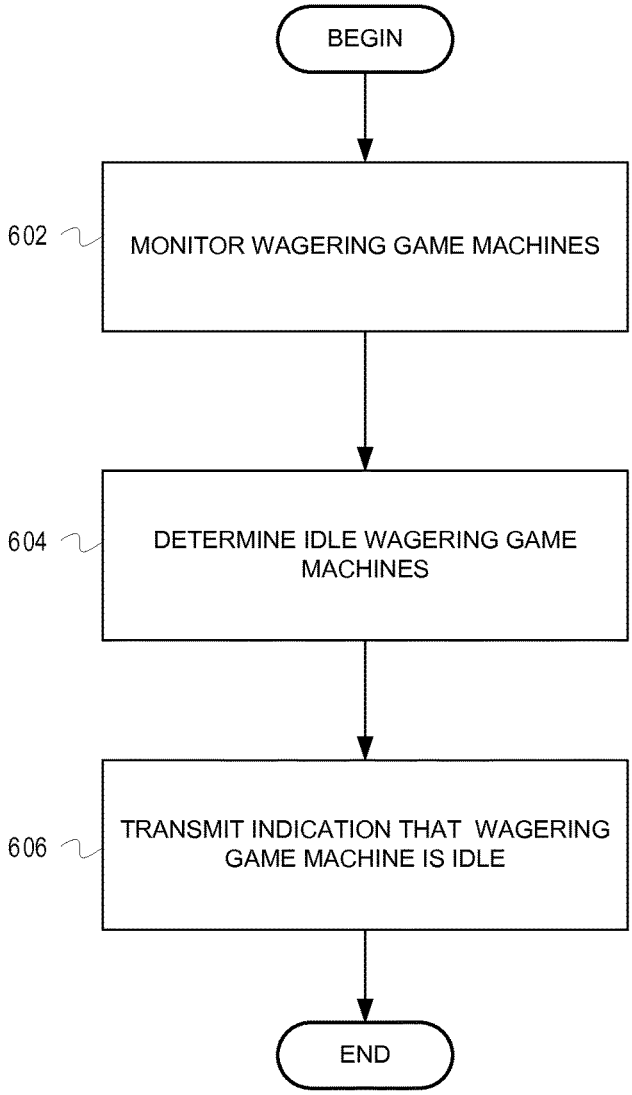
FIG. 6 is a flow diagram depicting example operations for determining idle wagering game machines and transmitting an indication of the idle wagering game machines.
Figure 7:
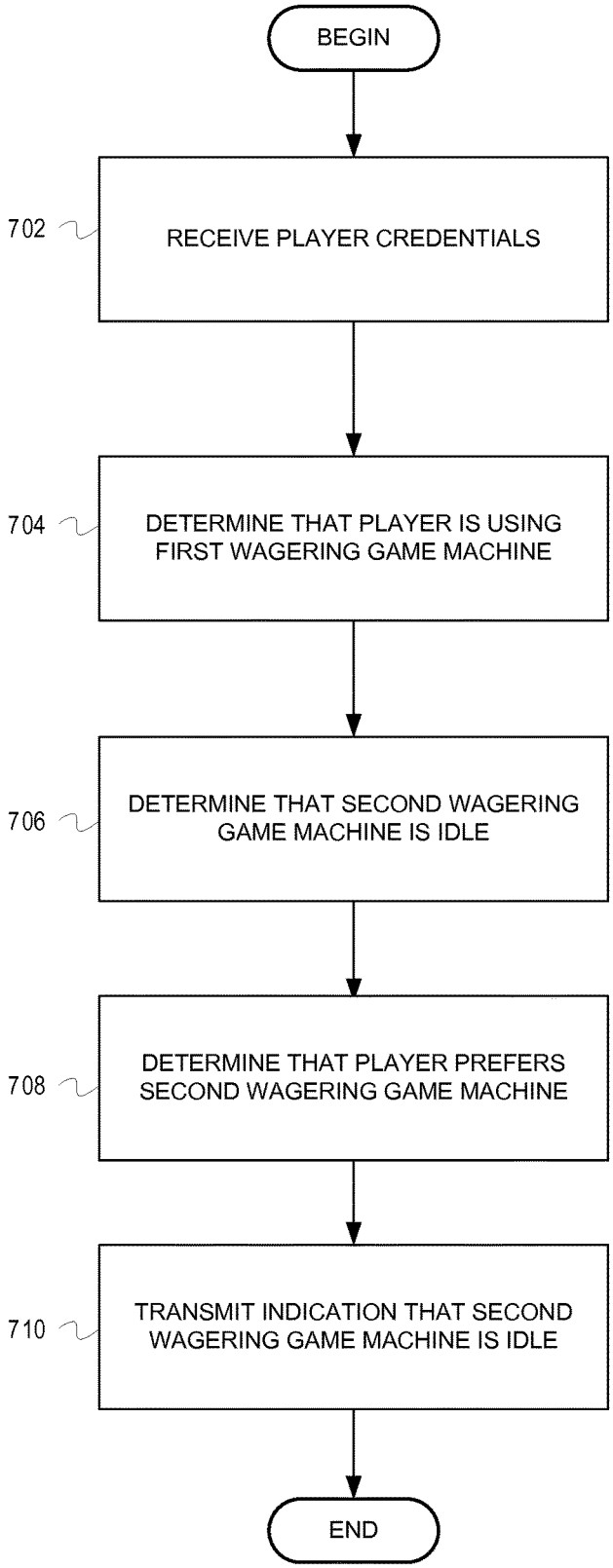
FIG. 7 is a flow diagram depicting example operations for determining that a wagering game machine matching a player's preferences is idle, and transmitting an indication that the wagering game machine is idle.

The section will discuss FIGS. 6 and 7. The discussion of FIG. 6 will describe operations for determining idle wagering game machines and transmitting an indication of the idle wagering game machines. The discussion of FIG. 7 will describe operations for alerting a player playing a first wagering game machine that a preferred wagering game machine is available.

FIG. 6 is a flow diagram depicting example operations for determining idle wagering game machines and transmitting an indication of the idle wagering game machines. The flow begins at bock 602.

At block 602, the wagering game machines are monitored to determine when they are idle. This monitoring can be done in any suitable way. For example, credits meters associated with the wagering game machines can be monitored. Alternatively, activity on the wagering game machines can be monitored. For example, gameplay on a wagering game machine can be monitored, whether a player is logged in at a wagering game machine, whether a player tracking card is inserted in a wagering game machine, whether a player has cashed out at a wagering game machine, whether there has been any player input (e.g., button presses) in the last five minutes on a wagering game machine, etc. The flow continues at block 604.

At block 604, it is determined which wagering game machines are idle. For example, when the credit meter has a balance of zero, it is likely that the wagering game machine is idle. Likewise, if there hasn't been any player input at the wagering game machine in the last several minutes, if no player is logged into the wagering game machine, if a player has recently cashed out at the wagering game machine, etc., it is likely that the wagering game machine is idle. Additionally, incentives for playing the idle wagering game machines can be determined. For example, a player can be offered a coupon for a free meal at a casino restaurant in exchange for playing the idle wagering game machine. In some embodiments, all wagering game machines have the same incentive (e.g., there is a free credit incentive to reserve and play any idle wagering game machine). In other embodiments, the incentive a player is being offered can be specific to the player and/or to the wagering game machine. For example, players having a certain status may be offered greater incentives, players can receive ten free spins for a slot machine, ten dollars in free credits for a video blackjack game, etc. The flow continues at block 606.

At block 606, an indication of idle wagering game machines is transmitted. This transmission can be accomplished via any suitable medium. For example, the indication can be transmitted via a communications network comprising Wi-Fi, 3G/4G telecommunications, short-range wireless (e.g., NFC, Bluetooth), etc.

FIG. 7 is a flow diagram depicting example operations for determining that a wagering game machine matching a player's preferences is idle, and transmitting an indication that the wagering game machine is idle. The flow begins at block 702.

At block 702, player credentials are received. The player credentials can include a player ID, player wagering game history, player preferences, player location information (e.g., in which casino the player is currently located), etc. The player preferences can include the players preferred wagering game machines, preferred types of wagering game machines, preferred wagering games, preferred themes, preferred volatility, preferred payback percentage, preferred bet amounts, etc. The player preferences can also include the player's preferred method of notification of idle wagering game machines. The flow continues at block 704.

At block 704, it is determined that the player is playing a first wagering game machine. This can be determined by a player logging into the first wagering game machine, the player inserting a tracking card at the first wagering game machine, the player's credit card used at the wagering game machine, proximity of the player's mobile device to the wagering game machine, etc. The flow continues at block 706.

At block 706, it is determined that a second wagering game machine is idle. Again, this can be determined in a variety of ways, such as monitoring the second wagering game machine's credit meter, player input at the second wagering game machine, etc. The flow continues at block 708.

At block 708, it is determined that the player prefers the second wagering game machine to the first wagering game machine. For example, the player credentials may indicate that the player spends a majority of their time playing Texas Hold 'Em on wagering game machines. Additionally, the first wagering game machine may only offer video blackjack, and the second wagering game machine may offer Texas Hold 'Em. Based on the player credentials and content available on the second wagering game machine, it can be determined that the player prefers the second wagering game machine to the first wagering game machine. The flow continues at block 710.

At block 710, an indication that the second wagering game machine is available is transmitted. For example, the indication can be transmitted to the first wagering game machine and a notification (e.g., in a player interface window) can be presented on the first wagering game machine. Alternatively, the indication can be transmitted to the player's mobile device. The indication can also include an option to reserve the second wagering game machine, and an incentive available to the player for reserving/playing the second wagering game machine.

Operating Environment

This section describes an example operating environment and presents structural aspects of some embodiments. This section includes discussion about wagering game machine architectures and wagering game networks.

Wagering Game Machine Architectures

Figure 8:
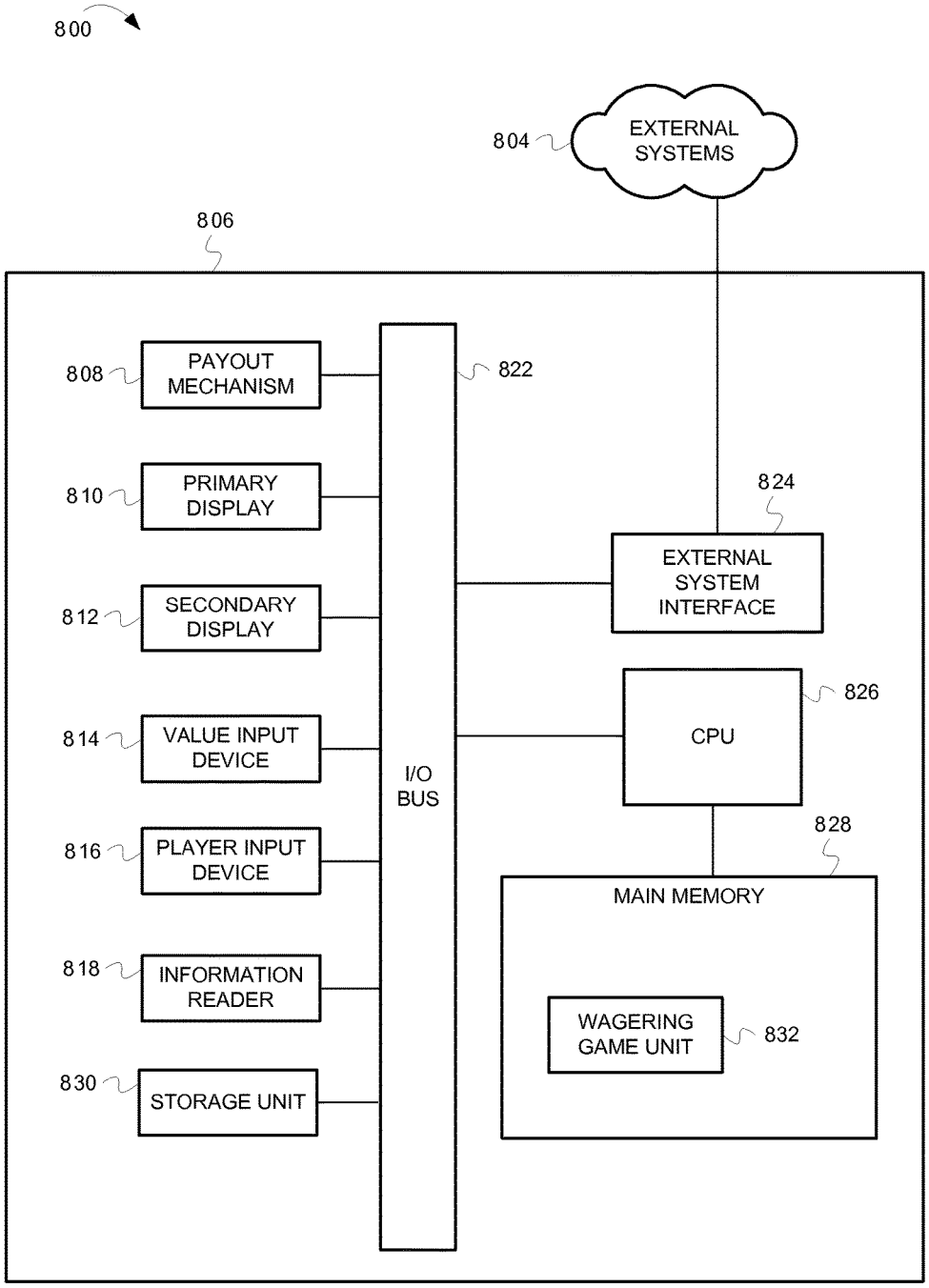
FIG. 8 is a block diagram illustrating a wagering game machine architecture, according to example embodiments of the invention.

FIG. 8 is a block diagram illustrating a wagering game machine architecture, according to example embodiments of the invention. As shown in FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832. In one embodiment, the wagering game unit 832 can present wagering games, such as video poker, video black jack, video slots, video lottery, etc., in whole or part.

The CPU 826 is also connected to an input/output (I/O) bus 822, which can include any suitable bus technologies, such as an AGTL+ frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems 804 (e.g., wagering game networks).

In one embodiment, the wagering game machine 806 can include additional peripheral devices and/or more than one of each component shown in FIG. 8. For example, in one embodiment, the wagering game machine 806 can include multiple external system interfaces 824 and/or multiple CPUs 826. In one embodiment, any of the components can be integrated or subdivided.

Any component of the architecture 800 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 8 describes an example wagering game machine architecture, this section continues with a discussion wagering game networks.

Wagering Game Networks

Figure 9:
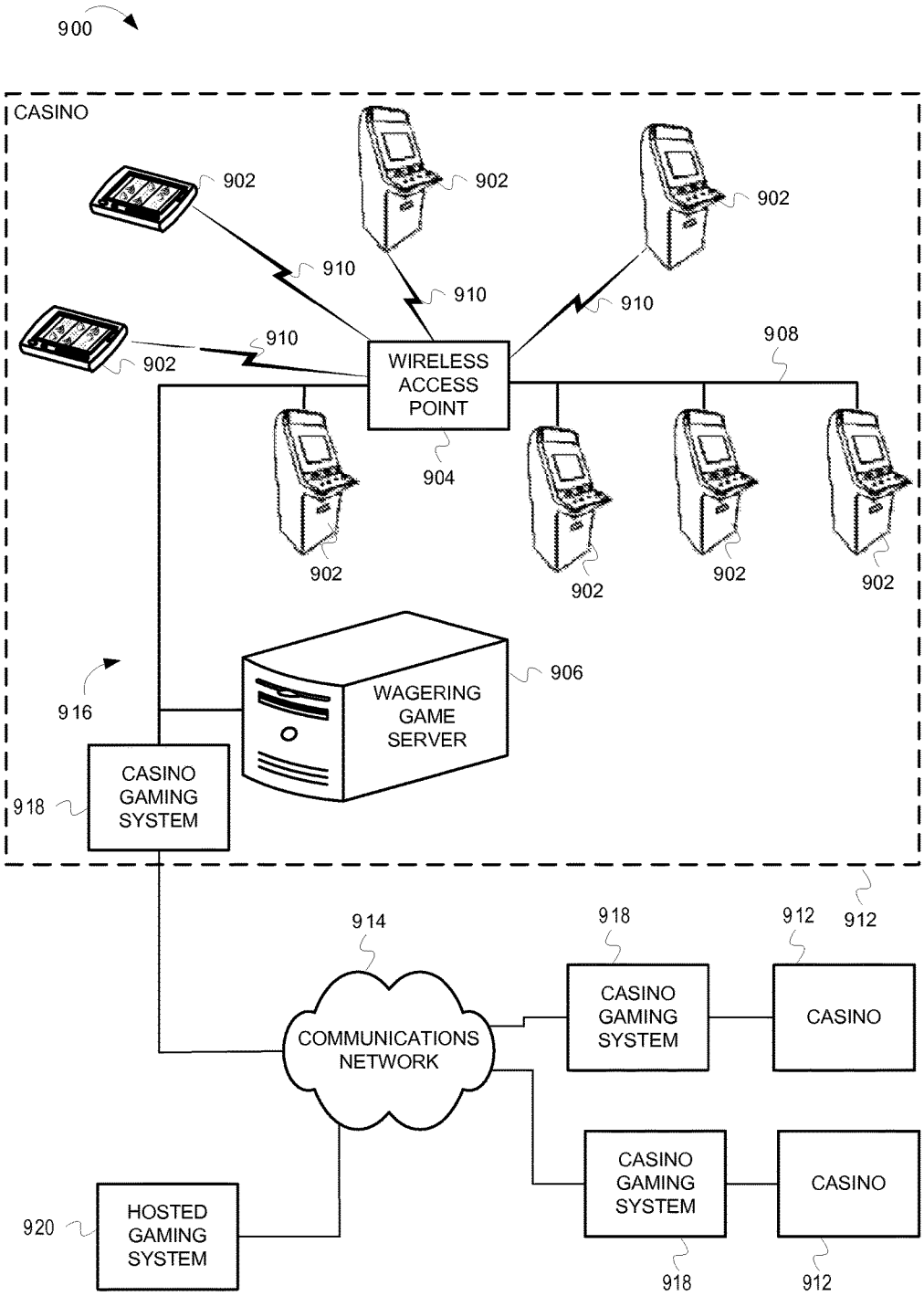
FIG. 9 is a block diagram illustrating a wagering game network 900, according to example embodiments of the invention.

FIG. 9 is a block diagram illustrating a wagering game network 900, according to example embodiments of the invention. As shown in FIG. 9, the wagering game network 900 includes a plurality of casinos 912 connected to a communications network 914.

Each casino 912 includes a local area network 916, which includes an access point 904, a wagering game server 906, wagering game machines 902, and a casino gaming system(s) 918. The access point 904 provides wireless communication links 910 and wired communication links 908. The wired and wireless communication links can employ any suitable connection technology, such as Bluetooth, 802.11, Ethernet, public switched telephone networks, SONET, etc. In some embodiments, the wagering game server 906 can serve wagering games and distribute content to devices located in other casinos 912 or at other locations on the communications network 914. The casino gaming system(s) is operable to monitor the wagering game machines 902 and transmit indications of idle wagering game machines to a hosted gaming system 920. Although the casino gaming system 918 is depicted as being in the casino 912, in some embodiments, the casino gaming system 918 is not physically located in the casino. The hosted gaming system 920 is operable to transmit indications of idle wagering game machines 902 to players, match idle wagering game machines 902 to players, etc., as described herein.

The wagering game machines 902 described herein can take any suitable form, such as floor standing models, handheld mobile units, bartop models, workstation-type console models, etc. Further, the wagering game machines 902 can be primarily dedicated for use in conducting wagering games, or can include non-dedicated devices, such as mobile phones, personal digital assistants, personal computers, etc. In one embodiment, the wagering game network 900 can include other network devices, such as accounting servers, wide area progressive servers, player tracking servers, and/or other devices suitable for use in connection with embodiments of the invention.

In some embodiments, wagering game machines 902 and wagering game servers 906 work together such that a wagering game machine 902 can be operated as a thin, thick, or intermediate client. For example, one or more elements of game play may be controlled by the wagering game machine 902 (client) or the wagering game server 906 (server). Game play elements can include executable game code, lookup tables, configuration files, game outcome, audio or visual representations of the game, game assets or the like. In a thin-client example, the wagering game server 906 can perform functions such as determining game outcome or managing assets, while the wagering game machine 902 can present a graphical representation of such outcome or asset modification to the user (e.g., player). In a thick-client example, the wagering game machines 902 can determine game outcomes and communicate the outcomes to the wagering game server 906 for recording or managing a player's account.

In some embodiments, either the wagering game machines 902 (client) or the wagering game server 906 can provide functionality that is not directly related to game play. For example, account transactions and account rules may be managed centrally (e.g., by the wagering game server 906) or locally (e.g., by the wagering game machine 902). Other functionality not directly related to game play may include power management, presentation of advertising, software or firmware updates, system quality or security checks, etc.

Any of the wagering game network components (e.g., the wagering game machines 902) can include hardware and machine-readable media including instructions for performing the operations described herein.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

monitoring, at a wagering game server, credit meters of a plurality of wagering game machines;

determining, at the wagering game server based on the monitored credit meters, that a wagering game machine of the plurality of wagering game machines is idle; and transmitting, to a mobile device via a communications network, an indication indicating that the wagering game machine is idle and that an incentive is available in exchange for gameplay on the wagering game machine;

receiving, via the communications network, a reservation request indicating that a player wants to reserve the wagering game machine; and reserving the wagering game machine.

2. The method of claim 1, further comprising:

determining, before transmitting the indication, that the player is in proximity to the wagering game machine, and wherein the mobile device is associated with the player.

3. The method of claim 2, wherein before the transmitting the indication, the method further comprising:

determining player preferences; and determining that the wagering game machine offers content matching the player preferences.

4. The method of claim 1, wherein the indication is transferred to one or more of an application program on the mobile device and a webpage on the mobile device.

5. The method of claim 1, wherein the incentive includes one or more of a free play, a bonus game, cashable gameplay credits, non-cashable gameplay credits, a game enhancement, a modified pay table, and casino services.

6. A method for notifying a player about idle wagering game machines in a casino, the method comprising:

registering, by a mobile device, to receive indications identifying wagering game machines that are idle;

receiving, by the mobile device, an indication identifying idle wagering game machines;

presenting, by the mobile device, a list of the idle wagering game machines and incentives available for playing each of the idle wagering game machines; and receiving, by the mobile device, player input to select one of the idle wagering game machines; and transmitting, by the mobile device in response to the player input, an indication to reserve the selected one of the idle wagering game machines.

7. The method of claim 6 further comprising:

providing a unique identifier to the mobile device, wherein the unique identifier must be entered at the selected one of the idle wagering game machines to enable gameplay.

8. The method of claim 6, wherein, in response to receiving the player input:

presenting directions indicating a route to the selected one of the idle wagering game machines.

9. The method of claim 6, wherein, in response to receiving the player input:

presenting an indication of content available on the one of the idle wagering game machines.

10. The method of claim 6, further comprising:

receiving, on a mobile device, login information for a player;

determining, based on the login information for the player, player preferences that indicate preferred content; and presenting, as part of the list of idle wagering game machines, indicia indicating those of the idle wagering game machines that offer the preferred content.

11. The method of claim 6, wherein the incentives include one or more of a free play, a bonus game, cashable gameplay credits, non-cashable gameplay credits, a game enhancement, a modified pay table, and casino services.

12. The method of claim 6, wherein the registering is achieved via one or more of an application program on the mobile device and a webpage visited on the mobile device.

13. A method comprising:

receiving, by a computing device, player credentials for a player;

determining, via the computing device, that the player is using a first wagering game machine;

determining, via the computing device, that a second wagering game machine is idle;

determining, via the computing device based on the player credentials, that the player prefers to play the second wagering game machine; and transmitting, over a communications network, an indication that the second wagering game machine is idle, wherein the indication includes an incentive to be exchanged for wagering gameplay on the second wagering game machine.

14. The method of claim 13, wherein the indication is transmitted to the first wagering game machine for presentation in a player interface window on the first wagering game machine.

15. The method of claim 13, wherein the player credentials are received from a mobile device.

16. The method of claim 13, wherein the player credentials are received from the first wagering game machine.

17. The method of claim 13, further comprising:

receiving, in response to the indication, a request to reserve the second wagering game machine.

18. The method of claim 17, further comprising;

transmitting, in response to receiving the request, a unique code that must be entered at the second wagering game machine to play the second wagering game machine.

19. One or more non-transitory computer readable storage media, having instructions stored therein, which, when executed by one or more processors, causes the one or more processors to perform operations that comprise:

monitoring, at a wagering game server, a plurality of wagering game machines;

determining, at the wagering game server, that a wagering game machine of the plurality of wagering game machines is idle; and transmitting, via a communications network, an indication indicating that the wagering game machine is idle and that an incentive available to a player for gameplay on the wagering game machine;

receiving, via the communications network, a reservation request indicating that the player wants to reserve the wagering game machine; and reserving the wagering game machine.

20. The one or more computer readable storage media of claim 19, wherein the indication is transmitted to one or more of a wagering game machine and a mobile device.

21. An wagering game server comprising:

at least one processor, and:

a non-transitory computer readable storage medium having computer usable code executed on the at least one processor, the computer usable program including program code including:

program code configured to receive player credentials for a player;

program code configured to monitor, by the wagering game server, a plurality of wagering game machines;

program code configured to determine, by the wagering game server, that a wagering game machine of the plurality of wagering game machines is idle;

program code configured to transmit, over a communications network, an indication that the wagering game machine is idle and that an incentive is available to a player for gameplay on the wagering game machine;

program code configured to receive, via the communications network, a reservation request indicating that the player wants to reserve the wagering game machine; and program code configured to reserve the wagering game machine.

22. The apparatus of claim 21, further including:

program code to determine, before transmission of the indication, that the player is in proximity to the wagering game machine, and wherein the mobile device is associated with the player.

* * * * *